United States Patent [19]

Handweiler et al.

[11] 4,019,436

[45] Apr. 26, 1977

[54] TECHNIQUE FOR PRODUCING A PRE-DISTORTED DESIGN FORMAT FOR USE IN TRANSFER PRINTING

[76] Inventors: Martin Handweiler, 568 Grand St., New York, N.Y. 10002; George Castanis, 444 6th Ave., New York, N.Y. 10011

[22] Filed: June 16, 1976

[21] Appl. No.: 696,765

[52] U.S. Cl. ..... 101/463; 101/41; 101/163; 101/170; 101/401.1; 101/426

[51] Int. Cl.[2] ..... B41F 17/00

[58] Field of Search ..... 101/41, 44, 401.1, 426, 101/170, 163, 150, 463, 35

[56] References Cited

UNITED STATES PATENTS

| | | | |
|---|---|---|---|
| 1,217,250 | 2/1917 | Wensel | 101/426 |
| 2,166,138 | 7/1939 | Gundlach | 101/35 |
| 2,202,464 | 5/1940 | Pattison | 101/426 |
| 2,748,696 | 6/1956 | Murray | 101/41 |
| 2,842,046 | 7/1958 | Murray | 101/41 |
| 3,701,317 | 10/1972 | Miyamoto et al. | 101/170 |

FOREIGN PATENTS OR APPLICATIONS

| | | | |
|---|---|---|---|
| 736,312 | 9/1955 | United Kingdom | 101/41 |
| 848,076 | 9/1960 | United Kingdom | 101/41 |

*Primary Examiner*—Clifford D. Crowder

[57] ABSTRACT

A technique for producing a pre-distorted design format on a printing plate for use in a print transfer system in which an inked design engraved on the plate is picked up by a soft transfer pad and applied to the irregular surface of an article to be decorated, the pad being forced against the surface and conforming thereto to impress the inked design thereon. In this technique, a physical master is created which is an exact replica of the article to be imprinted, the irregular surface of the master being engraved or otherwise prepared to accept ink to define the design which is to appear on the article. The design on the master is inked, and this inked design is picked up by the transfer pad and applied to the regular surface of a proof sheet, whereby the distortion in the design impressed on the proof sheet reflects the distortion introduced by transferring from the irregular to the regular surface. The desin appearing on the proof sheet is engraved on the printing plate to provide a pre-distorted format thereon which, when inked and transferred to the irregular surface of the article, produces an undistorted imprint thereon.

7 Claims, 6 Drawing Figures

Fig.4
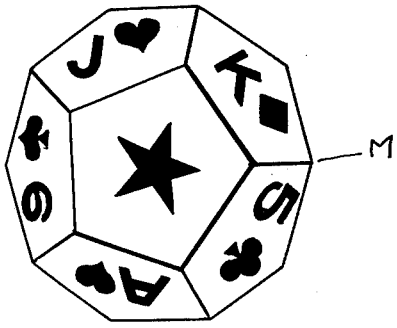
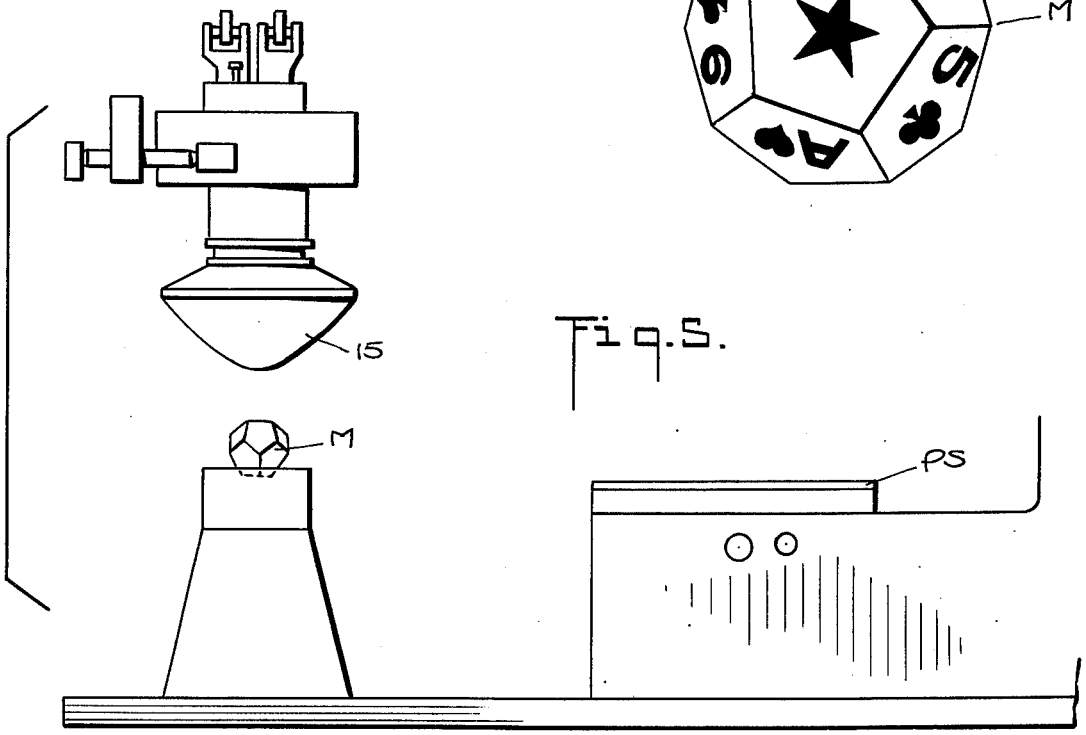
Fig.5.
Fig.6.
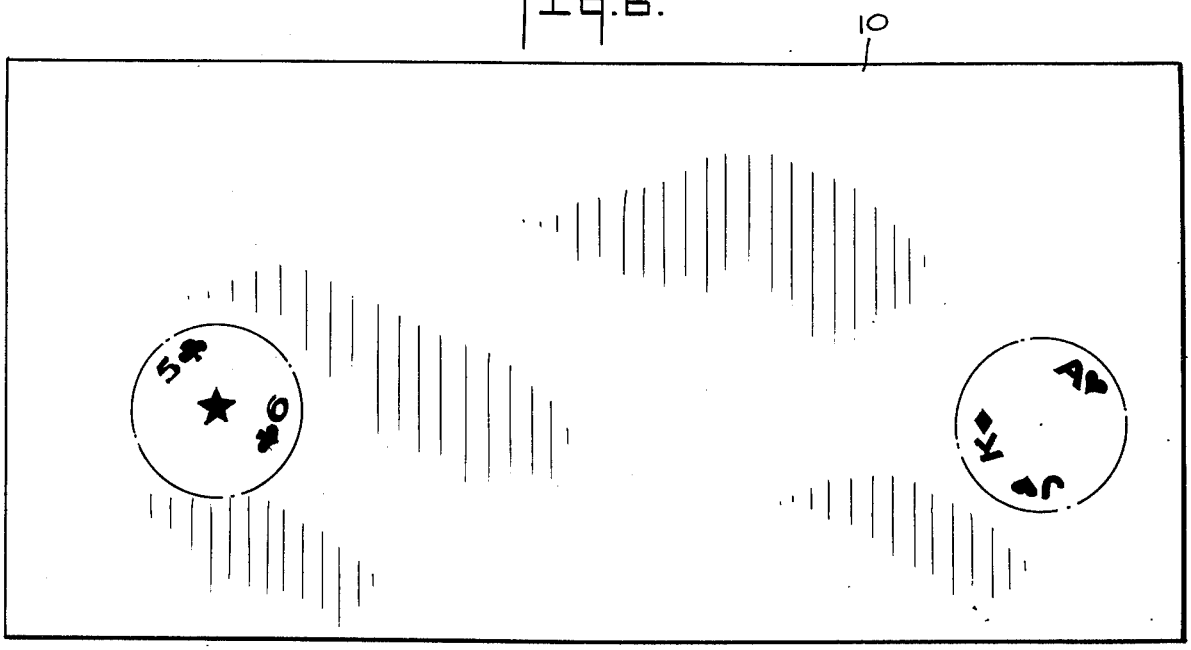

TECHNIQUE FOR PRODUCING A PRE-DISTORTED DESIGN FORMAT FOR USE IN TRANSFER PRINTING

BACKGROUND OF INVENTION

This invention relates generally to a printing system in which an inked design engraved on a printing plate is imprinted on an object having an irregular surface by means of a conformable transfer pad, and more particularly to a technique for creating a pre-distorted design on the printing plate which when transferred to the irregular surface imprints an undistorted design thereon.

Conventional printing machines, such as offset, intaglio and lithographic presses, are adapted to imprint or decorate planar or uniformly curved surfaces. In order to decorate or imprint objects having irregular surfaces, such as convex or concave-sided containers, multi-faceted dice or odd-shaped articles having ridged or recessed surfaces, it is now known to use the so-called Tampo-Print system. The Tampo-Print system, which is described in the article entitled "Decorating Breakthrough Copes with 'Impossible' Plastics Parts" appearing in the March 1972 edition of *Plastics World*, involves the use of a debossed metal printing plate and conformable transfer pad.

The design, decoration or printed matter to be impressed on the irregular surface of the object is acid-etched in the metal printing plate. In operation, the etched area is filled with pigment by a moving brush or squeegee which repeatedly carries the pigment from a reservoir. A doctor blade then cleans the surface of the plate to assure the absence of pigment from the non-decorated area, after which the transfer pad is pressed down on the plate to conform to and pick up the pigment from the etched area. Finally, the transfer pad is brought into contact with the object to be printed, all of the pigment being transferred thereto. After transfer, the pad is completely clean and free of residue.

The transfer pad is formed of soft, silicone rubber having a teat-shaped configuration and a smooth surface. When the pad is pressed down on the engraved or etched printing plate, the teat-shaped pad flattens out so that its surface engages the inked design thereon. When, thereafter, the soft pad engages the article to be decorated, the pad then undergoes a more complex distortion to conform its surface to the irregular surface of the article, thereby transferring the inked design carried by the pad to the surface of the article.

The nature of the distortion to which the pad is subjected when it is pressed against the flat printing plate to pick up the inked design is obviously quite different from the distortion it experiences when it is forced to conform to the irregular surface of the article being decorated. The difference which exists between the pick-up and impression modes obviously depends on the particular configuration of the article being printed.

In order to provide reasonably undistorted printing on the surface of the article, the present practice is to create a design format for the printing plate which is predistorted to an extent giving rise to an imprint on the article that is substantially free of distortion.

For example, if one is to print a drawing of a cat on a convex surface, optical means may be used in preparing the photographic master from which the printing plate is etched or engraved to pre-distort the image of the cat so that when this figure is transferred from the plate to the convex surface, it is substantially undistorted. In transferring from a flat to a simple convex surface by means of a teat-shaped transfer pad, one can very nearly predict the degree of pre-distortion which is needed to create an undistorted imprint.

But when the article to be printed has a more complex surface geometry, such as the surface of a twelve-sided die or dodecahedron, it is virtually impossible to predict the amount of predistortion which must be introduced in the printing plate format to insure an undistorted imprint on the die by the transfer pad. Hence the Tampo-Print system, using existing techniques for pre-distorting the design format on the printing plate, does not produce satisfactory designs on highly irregular or complicated surfaces.

SUMMARY OF INVENTION

In view of the foregoing, it is the main object of this invention to provide a technique for producing a design format on the printing plate employed in a print transfer system, which format is so pre-distorted as to cause the impression made by a conformable transfer pad on the irregular surface of an article to be undistorted.

While the invention will be described in connection with a design format which is debossed on the printing plate, it is to be understood that the technique is applicable to any transfer printing system without regard to whether the design on the plate is of the acid-etched, engraved, lithographed or in any other known form wherein the design area is adapted to accept ink and the non-design area to reject ink.

More specifically, it is an ojbect of the invention to provide a technique for producing a pre-distorted design format on a printing plate which obviates the need for optical and other known methods to effect the pre-distortion dictated by the surface geometry of the article to be decorated, and which makes possible the precise transfer printing and decorating of articles having irregular surfaces.

A significant feature of the invention resides in the fact that it renders feasible for the first time the accurate printing and decorating of articles whose irregular or complex surfaces were previously considered impractical to decorate with a high degree of precision. The invention is of particular value in producing multicolor designs in which color registration is important.

Briefly stated, these objects are attained in a technique for producing a pre-distorted design format on a planar printing plate for use in a print transfer system in which the inked design on the plate is picked up by a conformable transfer pad and applied to the irregular surface of an article to be decorated, the pad being forced against the surface and conforming thereto to impress the inked design thereon.

In this technique, a proof sheet is produced by first forming a physical master which is an exact replica of the article to be imprinted by the transfer pad. The irregular surface of the master is engraved or otherwise prepared to accept ink to define the design which is to appear on the article. The design on the master is then inked, and this inked design is picked up by the transfer pad and applied to the planar surface of the proof sheet.

The design imprinted on the proof sheet is distorted to a degree reflecting the distortion introduced by transferring from the irregular surface of the master to the planar surface of the proof sheet. The design appearing on the proof sheet is applied by acid-etching or other appropriate methods to the printing plate, thereby providing a pre-distorted format thereon which, when inked and transferred by the print transfer system to the article, produces an undistorted imprint thereon.

OUTLINE OF DRAWINGS

For a better understanding of the invention as well as other objects and further features thereof, reference is made to the following detailed description to be read in conjunction with the accompanying drawings, wherein:

FIG. 4 shows in perspective a typical physical master for use in a technique in accordance with the invention;

FIG. 5 illustrates schematically the method of deriving a proof from the master, and FIG. 6 is a plan view of the printing plate made from the proof.

DESCRIPTION OF INVENTION

The Tampo-Print System

Before discussing the technique in accordance with the invention, we shall first provide a brief description of the Tampo-Print print transfer system. Tampo-Print is the mark used commercially in connection with this system. For a more detailed disclosure of a print transfer system, reference is made to the Murray et al. U.S. Pat. No. 2,748,698 (1956), as well as to the article in *Plastics World*, previously identified.

Figure 1:
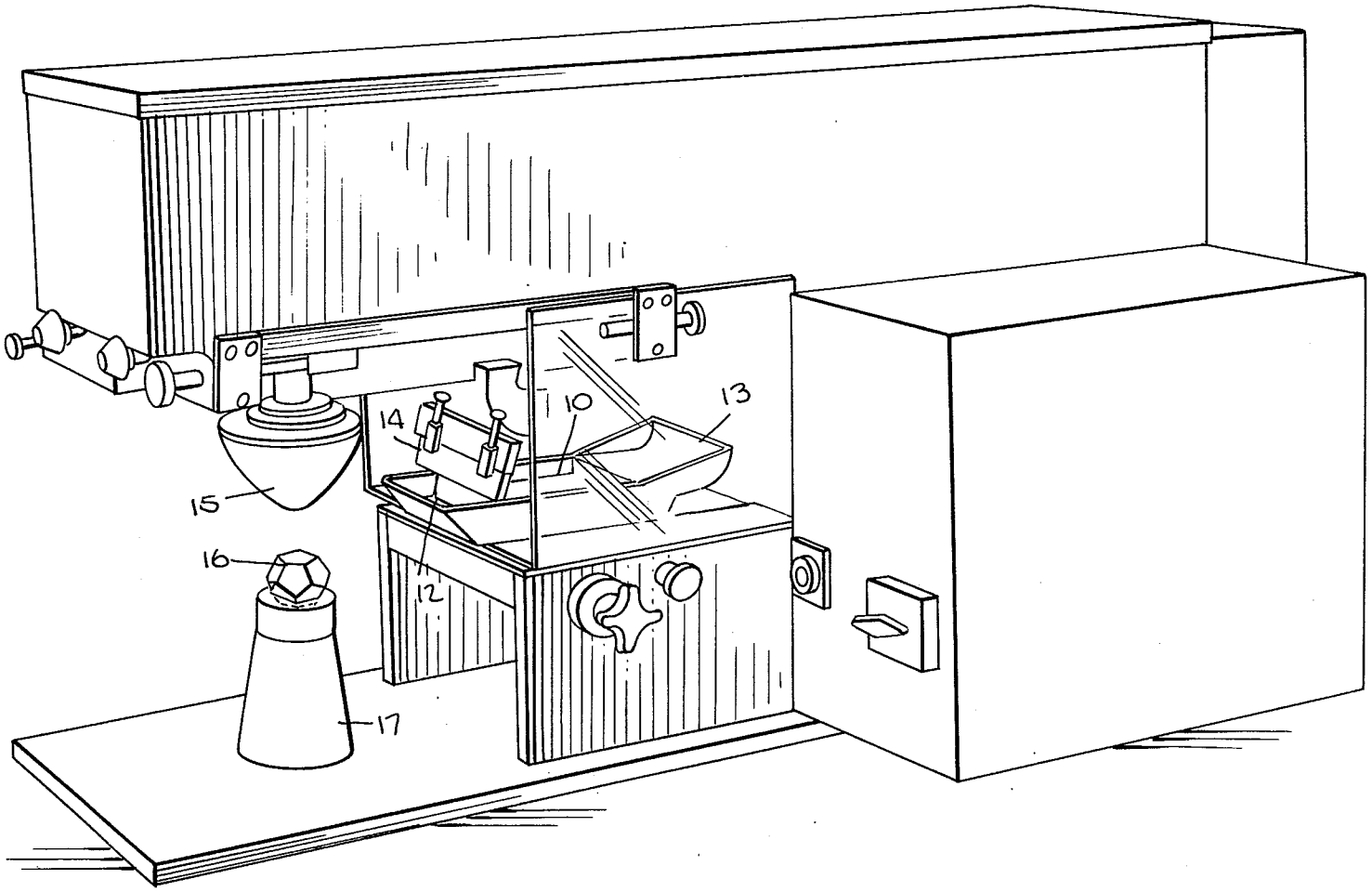
FIG. 1 is a perspective view of a standard Tampo-Print machine.
Figure 2:
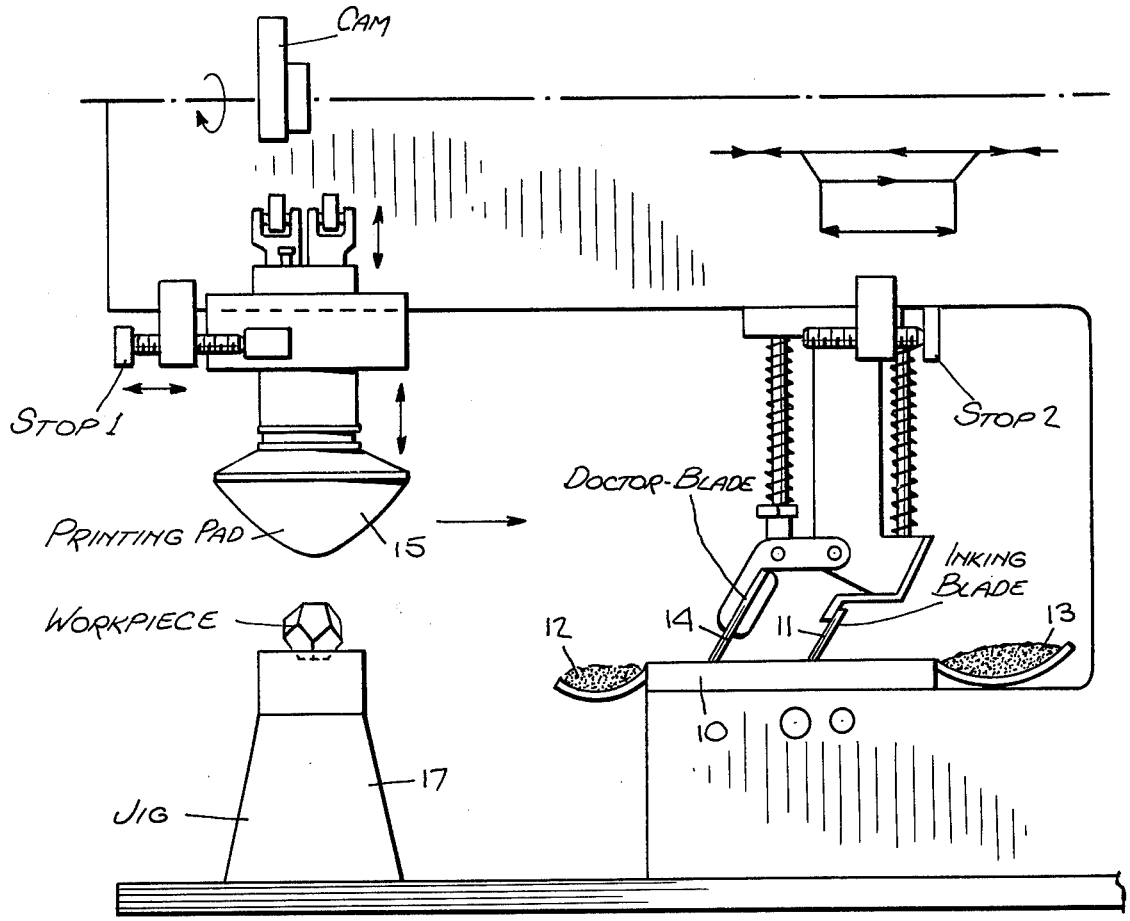
FIG. 2 is a schematic diagram of the machine.
Figure 3:
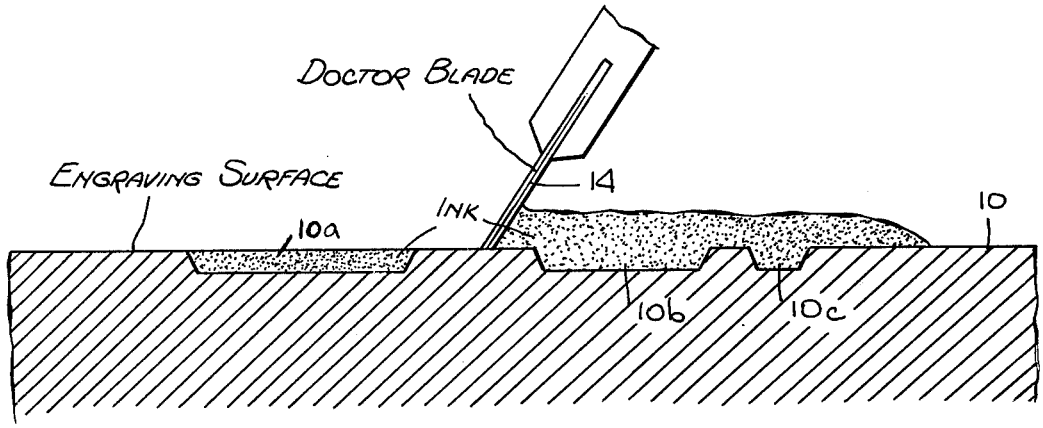
FIG. 3 is a sketch illustrating the printing plate.

As shown in FIGS. 1 to 3, the Tampo-Print system makes use of a debossed plate 10 which may be a chromium-plated copper plate on which the design format is acid-etched. The engraved surface of the plate is then filled with pigment by a moving brush 11 which carries the pigment from ink basins 12 and 13 placed on opposite ends of the printing plate.

A moving doctor blade 14 acts to clean the surface of the plate to remove any pigment from the non-design area. To effect transfer, use is made of an elastomeric, teat-shaped transfer pad 15 which, in practice, may be made of silicone rubber. The teat-shaped pad comes in a range of configurations, including a generally conical form. The form and dimensions of the pad used in the machine depends on the nature of the irregular surface to be imprinted.

Transfer pad 15 is lowered into contact with printing plate 10 and picks up the pigment from the etched zones, such as zones 10*a*, 10*b* and 10*c* in FIG. 3. The pigment is transferred to the irregular surface of the article 16 to be imprinted, the article being securely supported on a suitable jig 17. All of the pigment is transferred in each cycle of operation, leaving the pad completely clean after transfer. The Tampo-Print system will accept virtually any known type of printing ink or paint.

In the pick-up step, the transfer pad flattens out on the planar printing plate to engage all zones of the inked design format, while in the transfer step, the pad which engages the irregular surface of the article compresses and distorts to conform to the external contour of the article being decorated.

The sequence of operation is as follows:

A. On the forward motion of the moving brush or squeegee 11, the brush fills the etched zones of the printing plate 10 with ink.

B. On the return motion, doctor blade 14 wipes off the pigment from the planar surface of plate 10, so that pigment remains only in the debossed zones.

C. Then the conformable transfer pad 15 is brought down on plate 10 and is pressed against the printing plate to pick up pigment from the recessed areas therein. As the transfer pad thereafter moves toward article 16, squeegee 11 inks the plate in preparation for the next cycle.

D. Finally, transfer pad 15 is shifted to the article station and brought down to press against the irregular surface of the article. The pad distorts to conform to the sharp ridges or other iregularities in the surface contour of the article to deposit a reproduction of the design format on the printing plate.

Technique for Producing Pre-Distorted Design Format

By way of example, we shall consider the article to be decorated by the Tampo-Print system to be a dodecahedron-shaped die on each of whose faces there is to be imprinted a particular playing card symbol, such as the five of Hearts, the Ace (A) of Spaces, the nine of Clubs, etc., so that a set of such dice can be used to play a card game such as poker by rolling the dice.

This twelve-sided body has, of course, a complex surface, and when using the conventional technique for creating a suitable printing plate therefor, one must somehow predetermine how much distortion is necessary in the design format to be etched on the printing plate to obtain an undistorted imprint on the die.

In conventional practice, this is very difficult to achieve, for it must be done empirically. The artist who prepares a copy of the pre-distorted design tries, as best he can, to anticipate the degree of distortion encountered in the transfer process, and by trial and error he prepares a drawing which when etched on the printing plate results in fairly undistorted printing on the die.

However, it is not possible with the existing technique to provide a pre-distorted format on the printing plate which gives rise to printing on the die which is altogether free of distortion, for all that can be accomplished is a more or less rough approximation of the design. With the present technique, it becomes possible with a Tampo-Print system to decorate articles precisely, regardless of the complexity of their surfaces.

This is accomplished by first producing, as shown in FIG. 4, a master M which is an exact physical replica of the article to be printed, the material used for fabricating the master preferably being a material also suitable for making the printing plate. Thus in this instance, master M is a twelve-sided die made of chromium-plated copper. The facets of this master are then engraved or otherwise prepared by an artist, so that each facet bears an etching or engraving of the exact design to be carried thereon, say a nine of Clubs.

The technique and tools used for this purpose may be the same as those presently employed by artists in making original reliefs or etchings on metal plates. If a lithographic process is used, the master may be made of the same material as a lithographic plate onto which the design format is applied using lithographic procedures.

The master is then placed on jig 17 and inked by hand, as shown in FIG. 5, so that the inked design thereon can be picked up by transfer pad 15. The picked-up design is then transferred by the pad to a flat proof sheet PS which is supported on a flat platform normally used for accommodating the printing plate. Then when the transfer pad 15 embraces the physical master M, it distorts to conform to the contours thereof, and when the pad thereafter is transferred and pressed down and flattened on proof sheet PS, the degree of distortion in the design imprinted on the proof sheet precisely reflects the distortion introduced in the transfer process rather than being an approximation thereof.

The proof sheet is then used as the master copy from which the printing plate is prepared by photo-etching or other methods, as a consequence of which the format on the printing plate has that degree of pre-distortion necessary to produce perfect, undistorted impressions on the article to be decorated.

In FIG. 6, it will be seen that the printing plate 10 has two impressions thereon, one carrying the artwork for three faces of the die, and the other for three other faces of the die which is to be in a different color. With a twelve-sided die, the transfer pad is capable of embracing six sides, and the die must be turned around to embrace the other six.

Thus in the present technique, the Tampo-Print machine which is used to transfer a pre-distorted design from a printing plate to the irregular surface of a particular article is also used to create the pre-distorted design format which is applied to the plate. As a consequence, the transfer printing operation creates a design on the article which is faithful to that appearing on the physical master. Obviously, the quality of the printing depends on the quality of the physical master; but this presents no difficulty, for the master is a hand-made original, and by the proper exercise of skill and care, one can create a physical master free of flaws.

While there has been shown and described a technique in accordance with the invention for producing a pre-distorted design format for use in transfer printing, it will be appreciated that many changes and modifications may be made therein without, however, departing from the essential spirit thereof.

We claim:

1. The technique for producing a pre-distorted design format on a printing plate for use in a print transfer system in which the inked design on the plate is picked up by a conformable transfer pad and impressed on the irregular surface of an article to be imprinted, the pad being forced against the surface and being distorted to conform thereto, said technique comprising the steps of:

A. forming a physical master which is an exact replica of the article to be imprinted;

B. treating the surface of the master to create a distortion-free design thereon which is capable of accepting ink;

C. inking the design on the master;

D. picking up the inked design on the master by the transfer pad and pressing the inked transfer pad onto a proof sheet to produce thereon a distorted design whose degree of distortion reflects the transfer process; and E. producing a printing plate having said distorted design thereon whereby when articles are printed by transfer from said printing plate, the design imprinted on said article conforms to the design on said physical master.

2. The technique as set forth in claim 1, wherein said transfer pad is teat-shaped.

3. The technique as set forth in claim 1, wherein said article has a dodecahedron formation.

4. The technique as set forth in claim 1, wherein said physical master is fabricated of the same material as said printing plate.

5. The technique as set forth in claim 1, wherein said treatment of the surface of the master involves etching said design thereon to accept ink.

6. The technique as set forth in claim 1, wherein said treatment of said surface is a lithographic treatment.

7. A machine for carrying out the technique set forth in claim 1, said machine comprising a jig to support said master, a platform to support said proof sheet, and a transfer mechanism to transfer said pad from the master to said platform.

* * * * *